US008740274B1

(12) United States Patent
Dugas

(10) Patent No.: US 8,740,274 B1
(45) Date of Patent: Jun. 3, 2014

(54) BAG-HOLDING APPARATUS

(71) Applicant: Carroll J. Dugas, Lafayette, LA (US)

(72) Inventor: Carroll J. Dugas, Lafayette, LA (US)

( * ) Notice: Subject to any disclaimer, the term of this patent is extended or adjusted under 35 U.S.C. 154(b) by 0 days.

(21) Appl. No.: 13/787,380

(22) Filed: Mar. 6, 2013

(51) Int. Cl.
*B66F 19/00* (2006.01)

(52) U.S. Cl.
USPC ..... 294/214

(58) Field of Classification Search
USPC ..... 294/1.3, 1.4, 59, 176, 214, 209, 1.5; 43/7, 11, 12; 383/12, 33; 119/161, 867, 119/802, 804–805; D30/162; 15/257.1, 15/257.4, 257.6, 257.7; 248/97, 100, 95, 248/99, 101
See application file for complete search history.

(56) References Cited

U.S. PATENT DOCUMENTS 900,221 A * 10/1908 Smith ..... 248/94
3,388,882 A 6/1968 Burroughs et al.
3,796,402 A * 3/1974 Trotta ..... 248/97
3,916,962 A * 11/1975 Stolt ..... 141/108
4,407,474 A 10/1983 Swenson
4,446,646 A * 5/1984 van't Veld ..... 43/12
5,611,507 A * 3/1997 Smith ..... 248/99
D391,722 S 3/1998 Sheppard
5,899,419 A 5/1999 Ross et al.
6,116,549 A 9/2000 Santa Cruz et al.
6,237,878 B1 5/2001 Nelson
6,386,606 B1 * 5/2002 Marshall ..... 294/1.5
6,688,562 B1 2/2004 Harvey
2011/0290956 A1 12/2011 Saue et al.

* cited by examiner

*Primary Examiner* — Stephen Vu

(57) ABSTRACT

A bag-holding apparatus retains a bag in an open configuration to permit food and drinks to be poured into the bag without spilling. The apparatus includes a rod having a first end and a second end. A hoop is coupled to the first end of the rod. A plurality of clips is coupled to the hoop. The clips extend downwardly from the hoop wherein the clips are configured to retain a bag in an open configuration to facilitate transfer of an item from an exterior container into the bag. The clips are coupled to an outer surface of the hoop. A handle is coupled to a second side of the rod wherein the handle is configured for manual grasping to facilitate transfer of the item from the exterior container into the bag.

13 Claims, 3 Drawing Sheets

BAG-HOLDING APPARATUS

BACKGROUND OF THE DISCLOSURE

Field of the Disclosure

The disclosure relates to holding apparatuses and more particularly pertains to a new holding apparatus for retaining a bag in an open configuration to permit food and drinks to be poured into the bag without spilling.

SUMMARY OF THE DISCLOSURE

An embodiment of the disclosure meets the needs presented above by generally comprising a rod having a first end and a second end. A hoop is coupled to the first end of the rod. A plurality of clips is coupled to the hoop. The clips extend downwardly from the hoop wherein the clips are configured to retain a bag in an open configuration to facilitate transfer of an item from an exterior container into the bag. The clips are coupled to an outer surface of the hoop. A handle is coupled to a second side of the rod wherein the handle is configured for manual grasping to facilitate transfer of the item from the exterior container into the bag.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
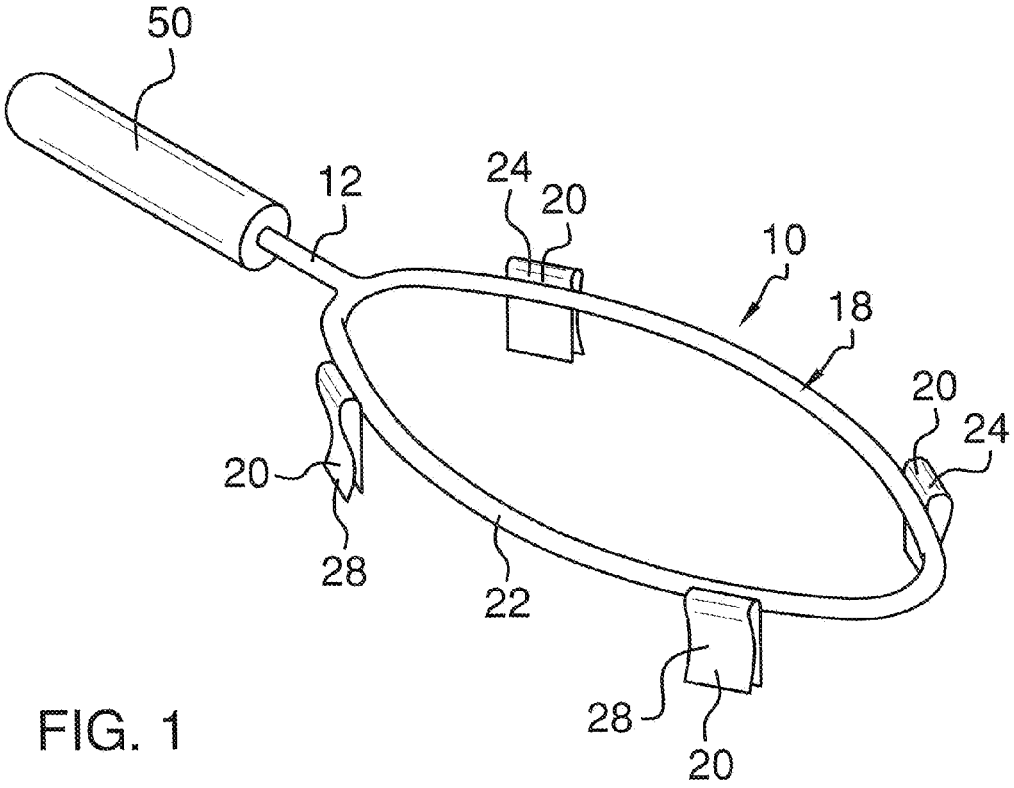
FIG. 1 is a top front side perspective view of a bag-holding apparatus according to an embodiment of the disclosure.
Figure 2:
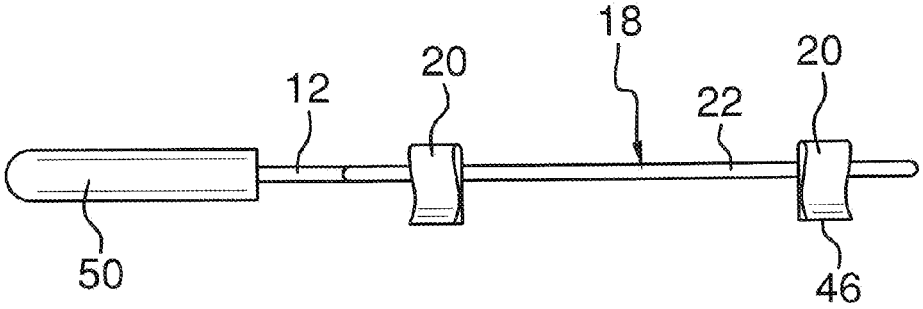
FIG. 2 is a side view of an embodiment of the disclosure.
Figure 3:
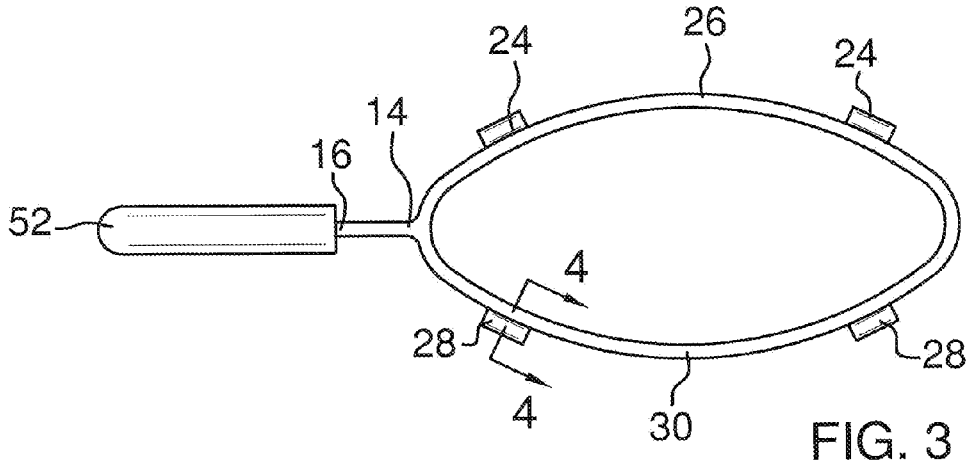
FIG. 3 is a top view of an embodiment of the disclosure.
Figure 4:
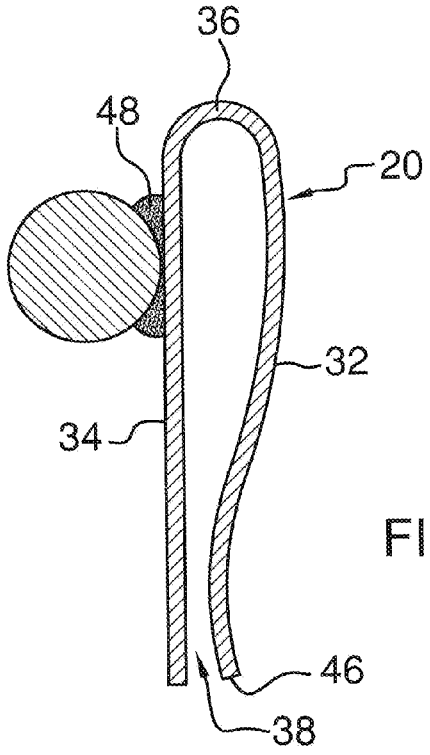
FIG. 4 is a cross-sectional view of an embodiment of the disclosure taken along line 4-4 of FIG. 3.
Figure 5:
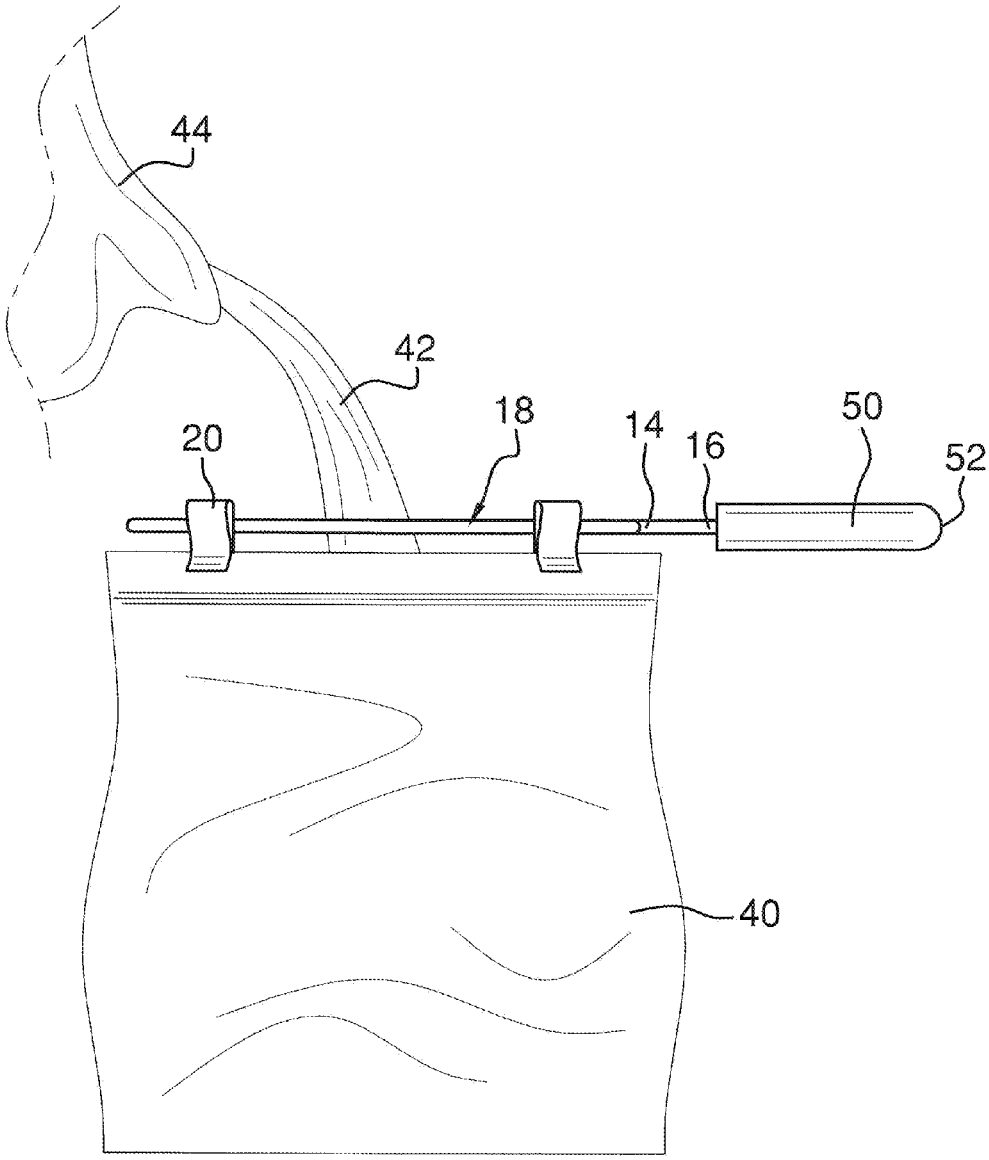
FIG. 5 is a side view of an embodiment of the disclosure in use.

With reference now to the drawings, and in particular to FIGS. 1 through 5 thereof, a new holding apparatus embodying the principles and concepts of an embodiment of the disclosure and generally designated by the reference numeral 10 will be described.

As best illustrated in FIGS. 1 through 5, the bag-holding apparatus 10 generally comprises a rod 12 having a first end 14 and a second end 16. A hoop 18 is coupled to the first end 14. The hoop 18 may be circular or oval-shaped. A plurality of spaced clips 20 is coupled to and extends downwardly from the hoop 18 wherein the clips 20 are configured to retain a bag 40 in an open configuration between a first side 26 and a second side 30 of the hoop 18 to facilitate transfer of an item 42 from an exterior container 44 into the bag 40. The item 42 may include food, liquids, or the like. The bag 40 used preferably is of a zip-lock style. A weight of the bag 40 bears on the clips 20 when the bag 40 is suspended from the clips 20. The clips 20 are coupled to an outer surface 22 of the hoop 18. The plurality of clips 20 comprises a first pair of clips 24 coupled to the first side 26 of the hoop 18 and a second pair of clips 28 coupled to the second side 30 of the hoop 18. Each of the clips 20 has a concave first side 32, a straight second side 34, and an arcuate top side 36 extending between the concave first side 32 and the straight second side 34. The straight second side 34 of each of the clips 20 is coupled to the hoop 18. A gap 38 is formed between the concave first side 32 and the straight second side 34. A distance of the gap 38 is greatest proximate the arcuate top side 36. A distance of the gap 38 is smallest proximate a bottom end 46 of each of the clips 20. The rod 12, the hoop 18, and the clips 20 are preferably made from stainless metal, such as stainless steel.

A fastener 48 couples each of the clips 20 to the hoop 18. A handle 50 is fixedly coupled to and extends outwardly from the second end 16 of the rod 12 wherein the handle 50 is configured for manual grasping to facilitate transfer of the item 42 from the exterior container 44 into the bag 40. The handle 50 is positioned transverse relative to the rod 12. The handle 50 has a curved bottom end 52.

The hoop 18 has a length between approximately 10 centimeters and 30 centimeters. The greatest distance between a first end 14 and a second end 16 of the rod 12 is between approximately 5 centimeters and 25 centimeters. The handle 50 has a length between approximately 5 centimeters and 25 centimeters.

In use, as stated above and shown in the Figures, the clips 20 are coupled to the hoop 18. A bag 40 is coupled to each of the clips 20 and is positioned to freely suspend downwardly from the clips 40 wherein the bag 40 extends between the first and second sides 26, 30 of the hoop 18. A user grasps the handle 50 with one hand while using the other hand to pour the item 42 from the exterior container 44 into the bag 40. The bag 40 is detached from the clips 20 and the apparatus 10 is stored.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A bag-holding apparatus comprising:

a rod having a first end and a second end;

a hoop coupled to said first end of said rod, said hoop having an oval shape and being elongated along a line extending through said rod, said hoop being a closed hoop, said rod lying in a plane of said hoop;

a plurality of clips coupled to said hoop, said clips extending downwardly from said hoop wherein said clips are configured to retain a bag in an open configuration between a first side and a second side of said hoop to facilitate transfer of an item from an exterior container into the bag, said clips being coupled to an outer surface of said hoop; and a handle coupled to a second end of said rod wherein said handle is configured for manual grasping to facilitate transfer of the item from the exterior container into the bag, said handle lying in said plane of said hoop, wherein said entire apparatus lies within a single plane.

2. The apparatus of claim 1, further comprising said plurality of clips being spaced.

3. The apparatus of claim 1, further comprising said plurality of clips comprising a first pair of clips coupled to a first side of said hoop and a second pair of clips coupled to a second side of said hoop.

4. The apparatus of claim 1, further comprising each of said clips having a concave first side, a straight second side, and an arcuate top side extending between said concave first side and said straight second side.

5. The apparatus of claim 4, further comprising said straight second side of each of said clips being coupled to said hoop.

6. The apparatus of claim 4, further comprising a gap being defined between said concave first side and said straight second side.

7. The apparatus of claim 6, further comprising a width of said gap from said concave first side to said straight second side being greatest proximate said arcuate top side.

8. The apparatus of claim 7, further comprising a said width being smallest proximate a bottom end of each of said clips.

9. The apparatus of claim 1, further comprising said handle extending outwardly from said second end of said rod, said handle being positioned transverse relative to said rod.

10. The apparatus of claim 1, further comprising said handle having a curved bottom end.

11. The apparatus of claim 1, further comprising said handle being fixedly coupled to said rod.

12. The apparatus of claim 1, further comprising said hoop being oval-shaped.

13. A bag-holding apparatus comprising:

a rod having a first end and a second end;

a hoop coupled to said first end of said rod, said hoop being oval-shaped, said hoop being elongated along a line extending along said rod, said rod lying in a same plane as said hoop, said hoop comprising a closed hoop;

a plurality of spaced clips coupled to and extending downwardly from said hoop wherein said clips are configured to retain a bag in an open configuration between a first side and a second side of said hoop to facilitate transfer of an item from an exterior container into the bag, said clips being coupled to an outer surface of said hoop, said plurality of clips comprising a first pair of clips coupled to a first side of said hoop and a second pair of clips coupled to a second side of said hoop, each of said clips having a concave first side, a straight second side, and an arcuate top side extending between said concave first side and said straight second side, said straight second side of each of said clips being coupled to said hoop;

a gap being defined between said concave first side and said straight second side, a width of said gap from said concave first side to said straight second side being greatest proximate said arcuate top side, a said width of said gap being smallest proximate a bottom end of each of said clips;

a fastener coupling each of said clips to said hoop; and a handle being fixedly coupled to and extending outwardly from said second end of said rod wherein said handle is configured for manual grasping to facilitate transfer of the item from the exterior container into the bag, said handle being positioned transverse relative to said rod, said handle having a curved bottom end, said handle lying in said plane of said hoop, wherein said entire apparatus lies within a single plane.

* * * * *